US007955232B1

(12) United States Patent
Chen

(10) Patent No.: US 7,955,232 B1
(45) **Date of Patent: *Jun. 7, 2011**

(54) PHYSICAL EXERCISING MACHINE

(76) Inventor: Paul Chen, Richmond (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/653,262

(22) Filed: Dec. 10, 2009

(51) Int. Cl.
*A63B 21/068* (2006.01)

(52) U.S. Cl. ..... 482/96; 482/72; 482/142

(58) Field of Classification Search ..... 482/51, 482/72, 92–96, 142
See application file for complete search history.

(56) References Cited

U.S. PATENT DOCUMENTS

| | | | | | |
|---|---|---|---|---|---|
| 231,869 | A | * | 8/1880 | Tuttle | 482/96 |
| 4,632,390 | A | * | 12/1986 | Richey | 482/96 |
| 4,949,958 | A | * | 8/1990 | Richey | 482/96 |
| 5,221,245 | A | | 6/1993 | Yeh | |
| 5,330,405 | A | | 7/1994 | Habing et al. | |
| 5,527,250 | A | | 6/1996 | Chen | |
| 5,645,514 | A | | 7/1997 | Chen | |
| 5,895,342 | A | * | 4/1999 | Solland | 482/96 |
| 5,899,836 | A | | 5/1999 | Chen | |
| 5,971,901 | A | * | 10/1999 | Shaw | 482/142 |
| 6,264,588 | B1 | * | 7/2001 | Ellis | 482/137 |
| 6,287,241 | B1 | * | 9/2001 | Ellis | 482/96 |
| 6,565,488 | B2 | | 5/2003 | Chen | |
| 6,916,278 | B2 | * | 7/2005 | Webber | 482/96 |
| 7,052,444 | B2 | * | 5/2006 | Webber | 482/93 |
| 7,549,949 | B2 | * | 6/2009 | Webber et al. | 482/99 |
| 7,766,802 | B2 | * | 8/2010 | Webber et al. | 482/100 |

FOREIGN PATENT DOCUMENTS

| | | | |
|---|---|---|---|
| RU | 2026699 | C1 * | 1/1995 |
| SU | 1831785 | A3 * | 9/1995 |
| SU | 1831787 | A3 * | 9/1995 |
| SU | 1830705 | A1 * | 10/1995 |

* cited by examiner

*Primary Examiner* — Loan Thanh
*Assistant Examiner* — Victor K Hwang
(74) *Attorney, Agent, or Firm* — Charles E. Baxley

(57) ABSTRACT

A physical exercising machine includes a base and a carrier, a lever attached to the carrier and inclined relative to the carrier and the base, a pivotal coupling mechanism pivotally coupled between the base and the carrier for horizontally moving the carrier and the user up and down relative to the base, a follower slidably engaged with the base and the lever for moving the platform and the user up and down relative to the base when the follower is moved along the base and along the inclined lever, and a cable coupled to the follower and having two end portions for being pulled by the user and for moving the follower to engage with the lever and to move the platform and the user up and down relative to the base.

17 Claims, 9 Drawing Sheets

PHYSICAL EXERCISING MACHINE

BACKGROUND OF THE INVENTION

1. Field of the Invention

The present invention relates to a physical exercising machine, and more particularly to a pull type physical exercising machine including an elevatable platform for stably supporting one or more users thereon and including a pulling cable coupled to the platform for pulling and elevating both the platform and the users and for exercising or training the upper muscle groups of the users.

2. Description of the Prior Art

Typical physical exercising machines comprise one or more weight members slidably attached and supported on a supporting stand, a seat attached to the supporting stand for supporting the user thereon, and a handle coupled to the weight members for pulling and elevating the weight members to exercise or train the upper muscle groups of the users.

For example, U.S. Pat. No. 5,221,245 to Yeh discloses one of the typical multifunction exercise apparatuses comprising a frame supporting various exercising stations which exercise different muscle groups, and a resistance adjusting assembly for adjusting a level of resistance in conjunction with the weight needed to be overcome in manipulation of the exercising station.

However, it is required to slidably attach and support the weight on a supporting stand, and required to provide a seat for supporting the user thereon, and required to provide a handle coupled to the weight members for pulling and elevating the weight members to exercise or train the upper muscle groups of the users, such that the typical multifunction exercise apparatuses include an expensive manufacturing cost.

U.S. Pat. No. 5,330,405 to Habing et al. discloses another typical exercise machine comprising a movable sub-frame on which a user sits while performing various exercises, the sub-frame is pivotally attached to a stationery frame and is supported by a lever arm that is also pivotally attached to the stationery frame, and a cable and pulley system coupling the lever arm to various operable members so that a selectable ratio of the weight of the sub-frame, including the user, is communicated as exercise resistance.

However, similarly, a complicated cable and pulley system is required to be provided to elevate or move the sub-frame in order to exercise or train the upper muscle groups of the users, such that the typical exercise machine is also expensive and is not competitive for the markets.

U.S. Pat. No. 5,527,250 to Chen discloses a further typical horse riding type exercise machine comprising a seat post pivotally attached to a base, a pole coupled between the seat post and the base, a pair of foot posts pivotally coupled to the seat post, and/or a pair of handles pivotally coupled to the seat post for both pulling and stepping exercises.

However, the typical horse riding type exercise machine may not be used to suitably exercise or train the upper muscle groups of the users.

U.S. Pat. No. 5,645,514 to Chen discloses a still further typical pulling type exercise machine comprising a resilient band attached to a base tube for supporting the knee portion or the lower portion of the user, an extension slidably engaged in the base tube, and a frame attached to the front end of the extension for supporting a shaft and a pulley and for exercising or training the upper muscle groups and/or the lower muscle groups of the users.

However, the user may not feel comfortable while sitting on the resilient band, and the user may not pull and elevate the user or may not overcome the weight of the user.

U.S. Pat. No. 5,899,836 to Chen discloses a still further typical exercise machine comprising a lever pivotally attached to a base and including a bracket and a seat cushion pivotally attached on top for supporting the user and for allowing the seat cushion and the user to be moved upwardly and downwardly to exercise or train the upper muscle groups of the users.

However, the user may step onto the foot support to elevate the seat cushion and the user such that the user may not suitably exercise or train the upper muscle groups of the users.

U.S. Pat. No. 6,565,488 to Chen discloses a still further typical exercise machine comprising a base including a seat cushion for supporting the user, a back frame rotatably coupled or attached to the base with a pivot axle for supporting the back of the user and for allowing the user to force and to rotate the back frame relative to the base.

However, the user may also step onto the foot support to exercise or train the lower muscle groups of the users, but may not be used to suitably exercise or train the upper muscle groups of the users.

The present invention has arisen to mitigate and/or obviate the afore-described disadvantages of the conventional physical exercising machines.

SUMMARY OF THE INVENTION

The primary objective of the present invention is to provide a physical exercising machine including an elevatable platform for stably supporting one or more users thereon and including a pulling cable coupled to the platform for pulling and elevating both the platform and the users and for exercising or training the upper muscle groups of the users.

In accordance with one aspect of the invention, there is provided a physical exercising machine comprising a base including at least one rail, a carrier including a platform for supporting a user thereon, a lever attached to the carrier and inclined relative to the carrier and the base, a pivotal coupling mechanism pivotally coupled between the base and the carrier for allowing the carrier and the user to be supported horizontally on the platform and to be moved vertically up and down relative to the base, an actuating mechanism including a follower slidably engaged with the rail and to be moved along the rail of the base, and slidably engaged with the lever for moving the platform and the user vertically up and down relative to the base when the follower is moved along the rail of the base and when the follower is moved along the inclined lever, and a cable coupled to the follower and including two end portions for being pulled by the user and for moving the follower to engage with the lever and to move the platform and the user vertically up and down relative to the base.

The follower includes a roller disposed thereon for engaging with the lever and for moving the platform and the user vertically up and down relative to the base.

The follower includes at least one pulley disposed thereon for engaging with the cable. The follower includes at least one second pulley disposed thereon for engaging with the cable.

The follower includes at least one roller engaged with the rail and to be moved along the rail of the base. The cable includes a hand grip attached to each of the end portions thereof for being pulled by the user.

The carrier includes a vibrating device for vibrating the carrier and the user. The vibrating device is attached to the platform of the carrier. The platform includes two openings formed therein for engaging with the end portions of the cable.

The lever includes a first end portion pivotally attached to the carrier and includes a second end portion, and the carrier includes a shank having at least two notches formed in the shank, and a latch attached to the second end portion of the lever for engaging with either of the at least two notches of the shank and for adjustably attaching the second end portion of the lever to the carrier, and for adjusting an inclination of the lever relative to the platform and the base.

The actuating mechanism includes two rocker assemblies pivotally coupled between the base and the carrier. The rocker assemblies each include two rocker arms each having a lower portion pivotally coupled to the base, and each having an upper portion pivotally coupled to the carrier.

The rocker arms each include a tube disposed on the upper portion thereof, and a shaft engaged with the tubes, and the lever includes a first end portion pivotally attached to the carrier with the shaft.

The actuating mechanism may include two or more followers slidably engaged with the rails and to be moved along the rails, and include a roller slidably engaged with the lever for moving the platform and the user vertically up and down relative to the base when the followers are moved along the rails and when the followers are moved along the inclined lever.

The actuating mechanism includes a rod coupled between the followers, and the roller is disposed on the rod for engaging with the lever. The followers each include a first pulley and at least one second pulley disposed thereon for engaging with the cable. The followers each include at least one roller engaged with the rails and to be moved along the rails of the base.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
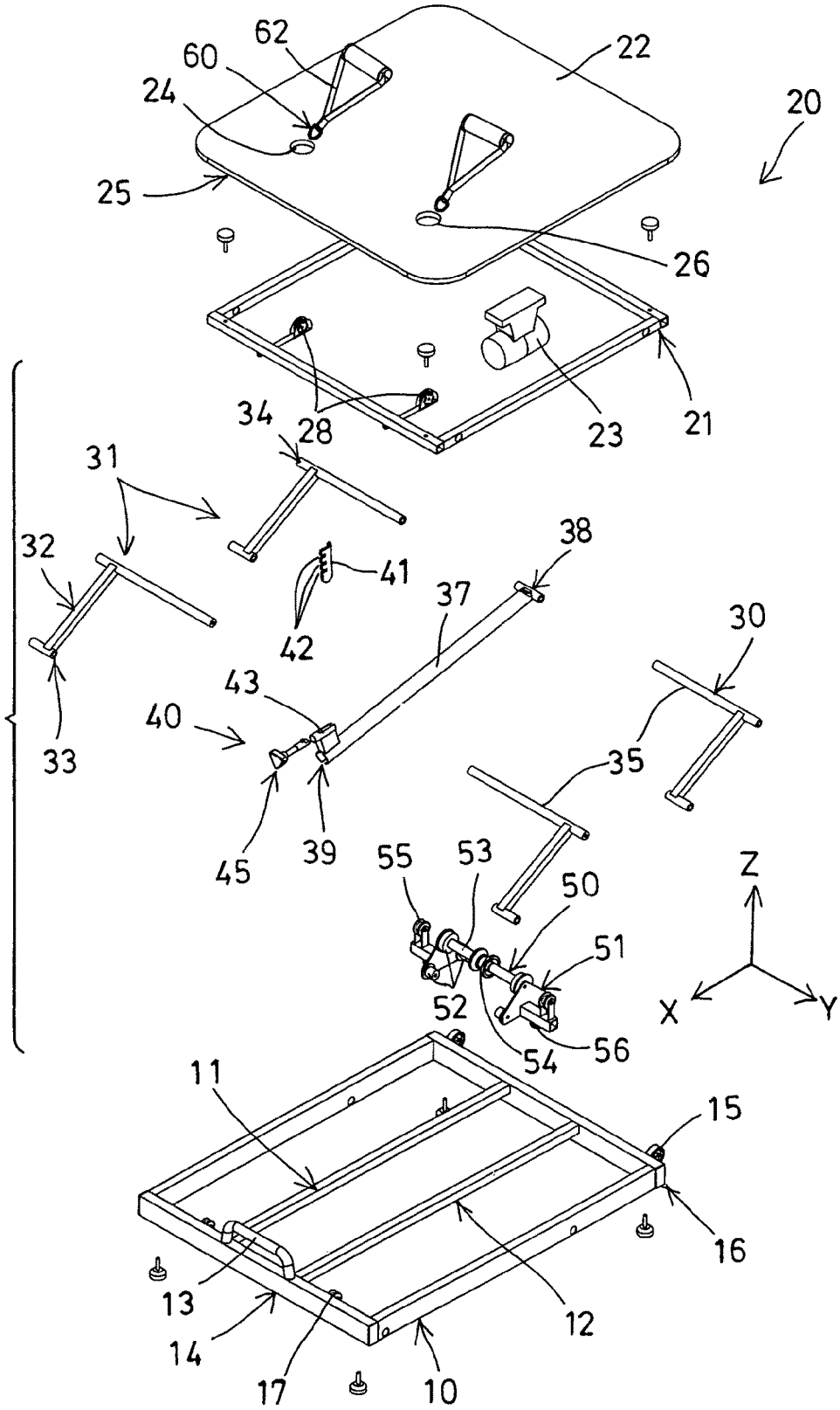
FIG. 1 is a partial exploded view of a physical exercising machine in accordance with the present invention.
Figure 2:
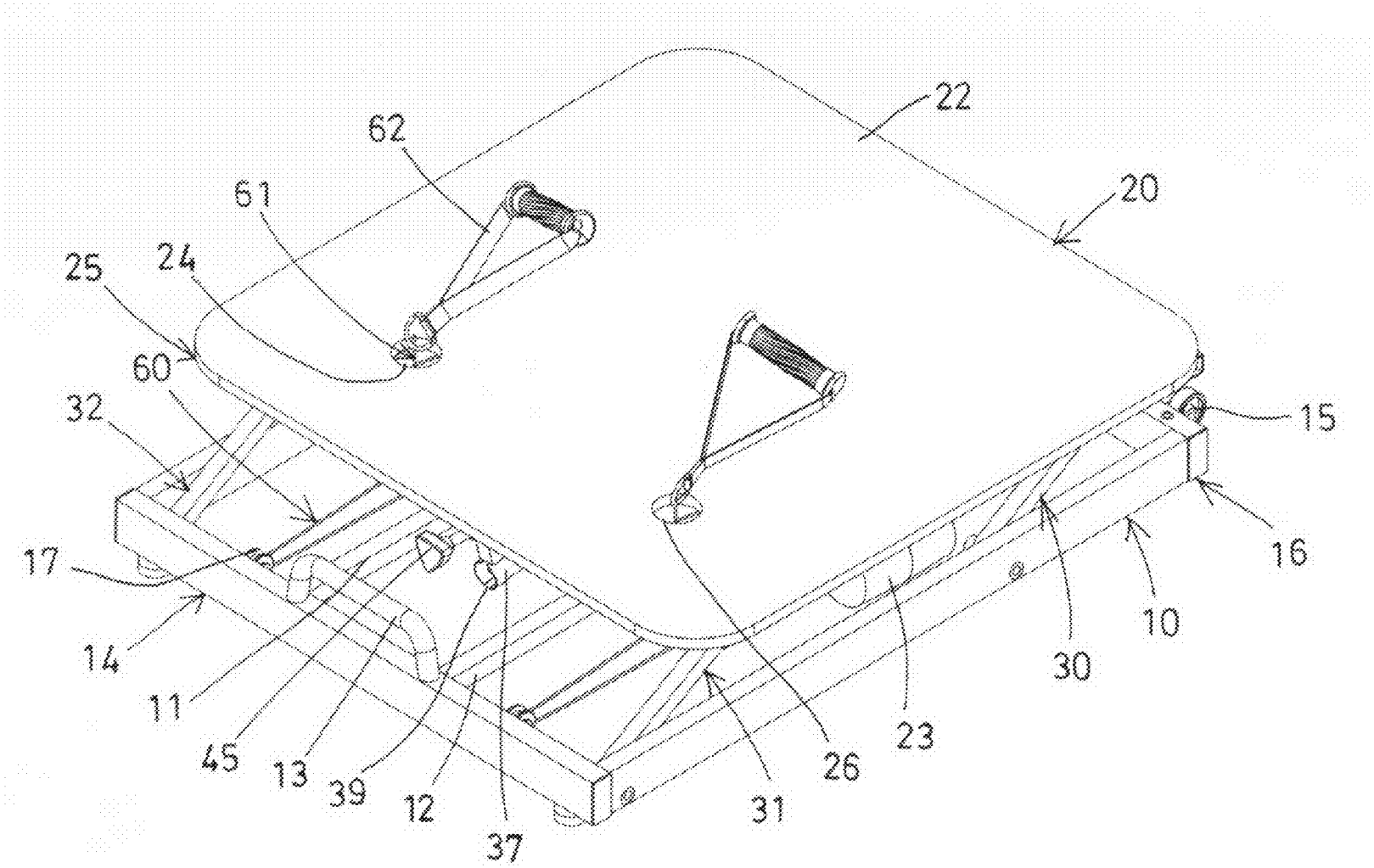
FIG. 2 is a perspective view of the physical exercising machine.
Figure 3:
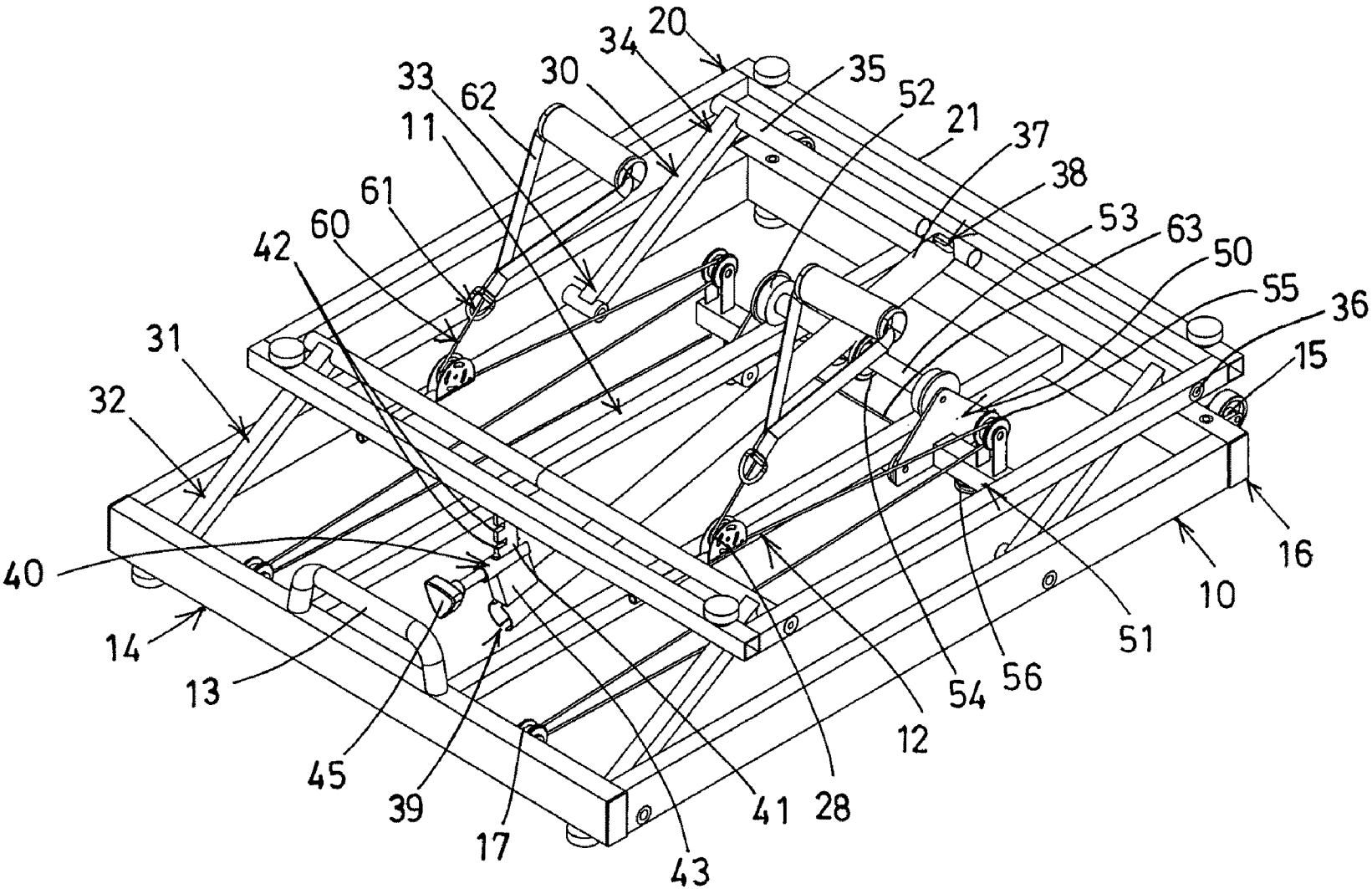
FIG. 3 is another perspective view of the physical exercising machine in which an upper elevatable platform has been removed for clearly showing the inner structure of the physical exercising machine.
Figure 4:
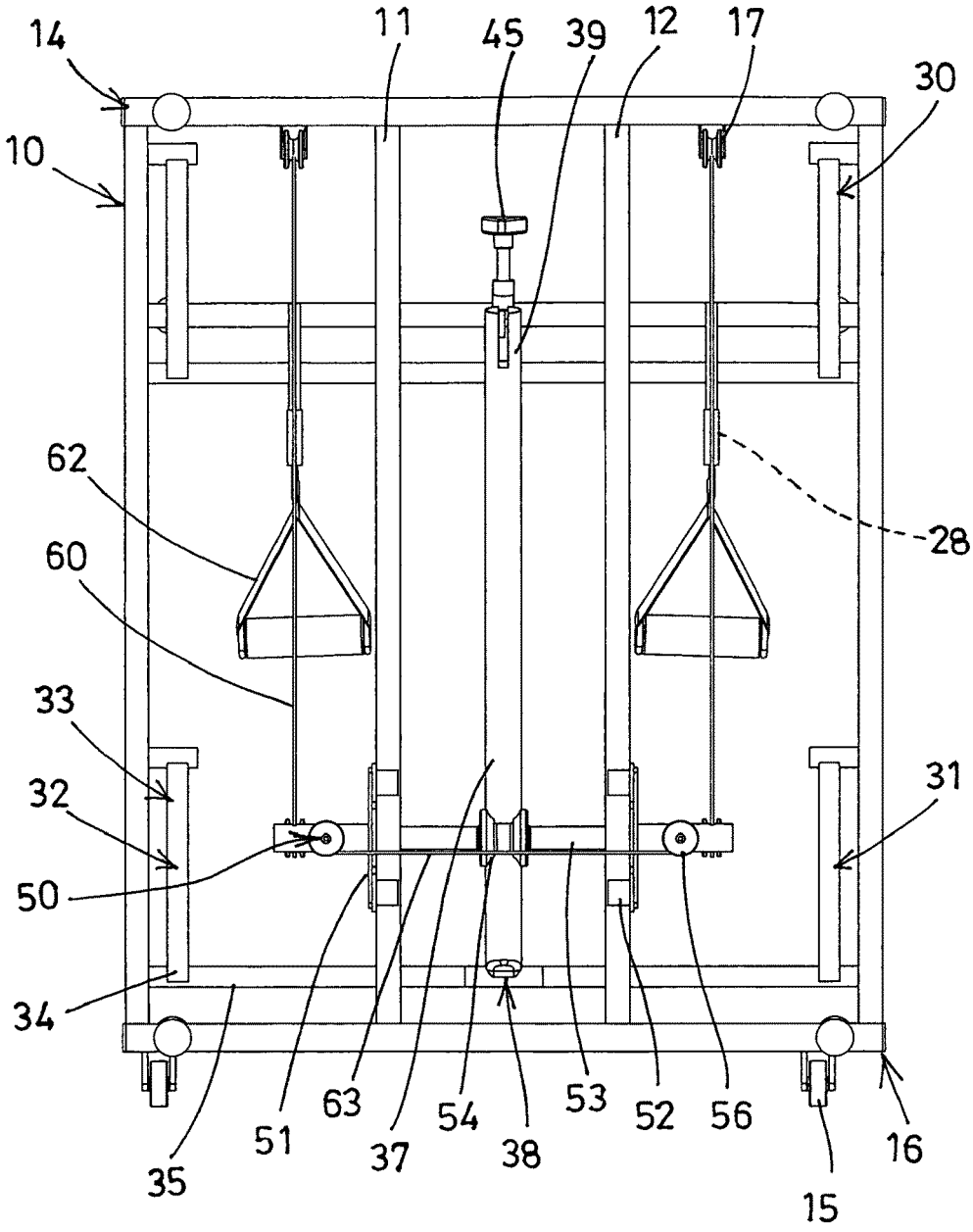
FIG. 4 is a bottom plan schematic view of the physical exercising machine, in which an upper carrier has been removed for showing a simplified and clear structure.

Referring to the drawings, and initially to FIGS. 1-5, a physical exercising machine in accordance with the present invention comprises a stationery frame or base 10 including one or more (such as two) tracks or rails 11, 12 disposed or attached and mounted therein and parallel to each other, and preferably arranged and parallel to the longitudinal axis or direction of the base 10 or X-axis, it is preferable that the base 10 includes a handle 13 attached and mounted to the front portion 14 thereof, and one or more (such as two) wheels 15 attached and mounted to the rear portion 16 thereof for allowing the base 10 to be easily moved to the other places or locations.

A movable support or carrier 20 is disposed or attached and mounted or supported above the base 10, and includes a frame 21 pivotally attached or coupled to the base 10 with a pivotal coupling mechanism 30, for example, the pivotal coupling mechanism 30 includes a pair of or two pivotal or rocker assemblies 31 each having two rocker arms 32, and the rocker arms 32 each include a lower portion 33 pivotally or rotatably coupled to the base 10, and each include an upper portion 34 pivotally or rotatably coupled to the frame 21 or the carrier 20, for example, the rocker assemblies 31 each include a tube 35 disposed or attached and mounted on the upper portion 34 of each of the rocker arms 32 for pivotally or rotatably coupling to the frame 21 or the carrier 20 and for allowing the frame 21 or the carrier 20 and the users 8 to be stably supported horizontally and to be moved vertically up and down relative to the base 10.

The rocker assemblies 31 each further include a shaft 36 pivotally or rotatably engaged in the tubes 35 of the rocker arms 32 (FIGS. 3 and 5-9), and the pivotal coupling mechanism 30 further includes a lever 37 having one end portion 38 pivotally or rotatably coupled to the tubes 35 or the upper portion 34 of the rocker arms 32 or the carrier 20 with the shaft 36 of one of the rocker assemblies 31 for attaching the lever 37 to the carrier 20, and the lever 37 is arranged parallel to the rocker arms 32 and the rails 11, 12 of the base 10 as seen from the upper or lower portion thereof (FIG. 4), and is tilted or inclined relative to the frame 21 or the carrier 20 and the base 10 as seen from the side portion thereof (FIGS. 5-9). The carrier 20 includes a platform 22 disposed or attached and mounted on the frame 21 for supporting one or more users 8 thereon (FIGS. 5, 6) and includes a vibrator or vibrating device 23 attached or mounted to the platform 22 for selectively vibrating the platform 22 and the users 8, and the platform 22 includes one or more (such as two) openings 24 formed therein, such as formed in the front portion 25 thereof and formed or defined by a smooth or curved or rounded inner peripheral surface 26.

An adjusting mechanism 40 includes a shank 41 attached or mounted to the frame 21 and/or the platform 22 and having one or more (such as three) notches 42 formed in the shank 41, and includes a seat 43 attached or mounted to the other end portion 39 of the lever 37, and a latch 45 slidably attached or mounted to the seat 43 of the lever 37 for being biased to selectively engage with either of the notches 42 of the shank 41 (FIGS. 7-9) and for adjustably attaching or coupling the other end portion 39 of the lever 37 to the frame 21 or the platform 22, and for adjusting the tilt or the inclination of the lever 37 relative to the frame 21 or the platform 22.

A moving or actuating mechanism 50 includes one or more (such as two) followers 51 each having one or more (such as three) rollers 52 for slidably attaching or coupling or engaging with the rails 11, 12 of the base 10 and for allowing the followers 51 of the actuating mechanism 50 to be moved or slid along the rails 11, 12 of the base 10 and/or the longitudinal axis or direction of the base 10 or X-axis, the actuating mechanism 50 may further include a rod 53 pivotally or rotatably coupled to or between the followers 51, and a pulley or roller 54 disposed or attached and mounted onto the rod 53 for slidably engaging with the lever 37 (FIGS. 5-9) and for moving the frame 21 or the platform 22 and the users 8 vertically up and down relative to the base 10 (FIGS. 5-6) when the followers 51 and the rod 53 of the actuating mechanism 50 are moved or slid along the rails 11, 12 of the base 10 and when the roller 54 or the followers 51 is moved along the inclined or tilted lever 37.

The actuating mechanism 50 may further include a further roller or pulley 55 disposed or attached and mounted onto each of the followers 51, such as attached and mounted on the upper portion of each of the followers 51, and one or more still further rollers or pulleys 56 disposed or attached and mounted onto each of the followers 51, such as attached and mounted on the lower portion of each of the followers 51, and the base 10 may further include one or more (such as two) further rollers or pulleys 17 disposed or attached and mounted onto the front portion 14 of the base 10. The actuating mechanism 50 may also include a single follower 51 slidably attached or engaged with one of the rails 11, 12 and having the roller 54 disposed thereon for slidably engaging with the lever 37 and for moving the frame 21 or the platform 22 and the users 8 vertically up and down relative to the base 10.

The physical exercising machine in accordance with the present invention further includes a wire or cable 60 having two end portions 61 engaged through the openings 24 of the platform 22, and includes a hand grip 62 attached and mounted to each of the end portions 61 thereof, the cable 60 is then engaged with the pulleys 55 of the followers 51 respectively (FIG. 3) or coupled to the followers 51, and then engaged with the pulleys 17 of the base 10, and then attached and mounted or coupled to the base 10 directly, or engaged with the pulleys 56 of the followers 51 respectively (FIG. 4), and having the middle portion 63 (FIGS. 3, 4) located between the pulleys 56 of the followers 51 and coupled together for forming a single cable 60, and arranged for allowing the followers 51 of the actuating mechanism 50 to be moved or slid along the rails 11, 12 of the base 10 when the end portions 61 of the cable 60 or the hand grips 62 are pulled by the users, in order to move or slide the roller 54 of the followers 51 relative to the lever 37, and so as to move the frame 21 or the platform 22 and the users 8 vertically up and down relative to the base 10. The actuating mechanism 50 may also include a single follower 51 having two pulleys 55 and a single pulley 56 for engaging with the cable 60.

Figure 5:
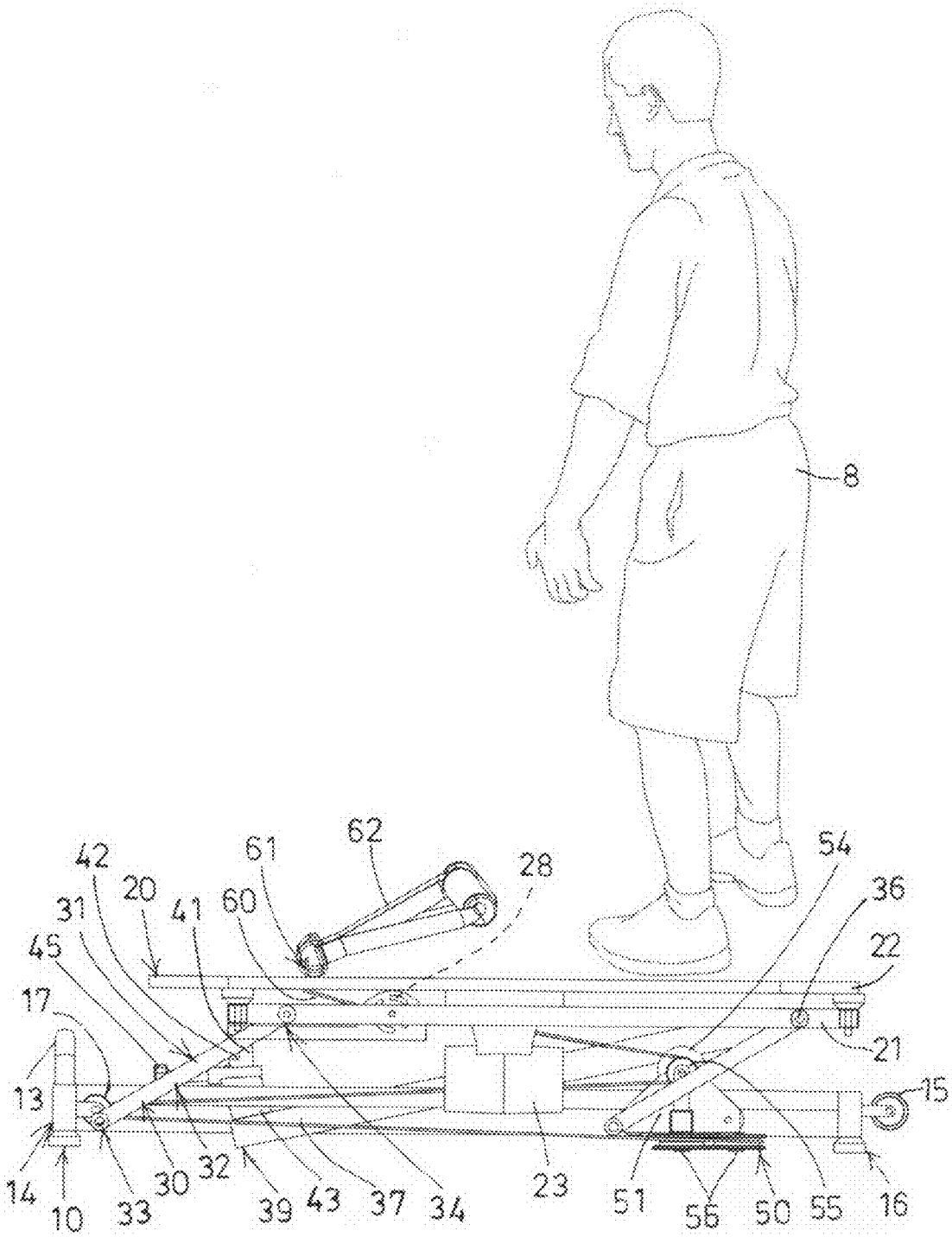
FIG. 5 is a side plan schematic view of the physical exercising machine.
Figure 6:
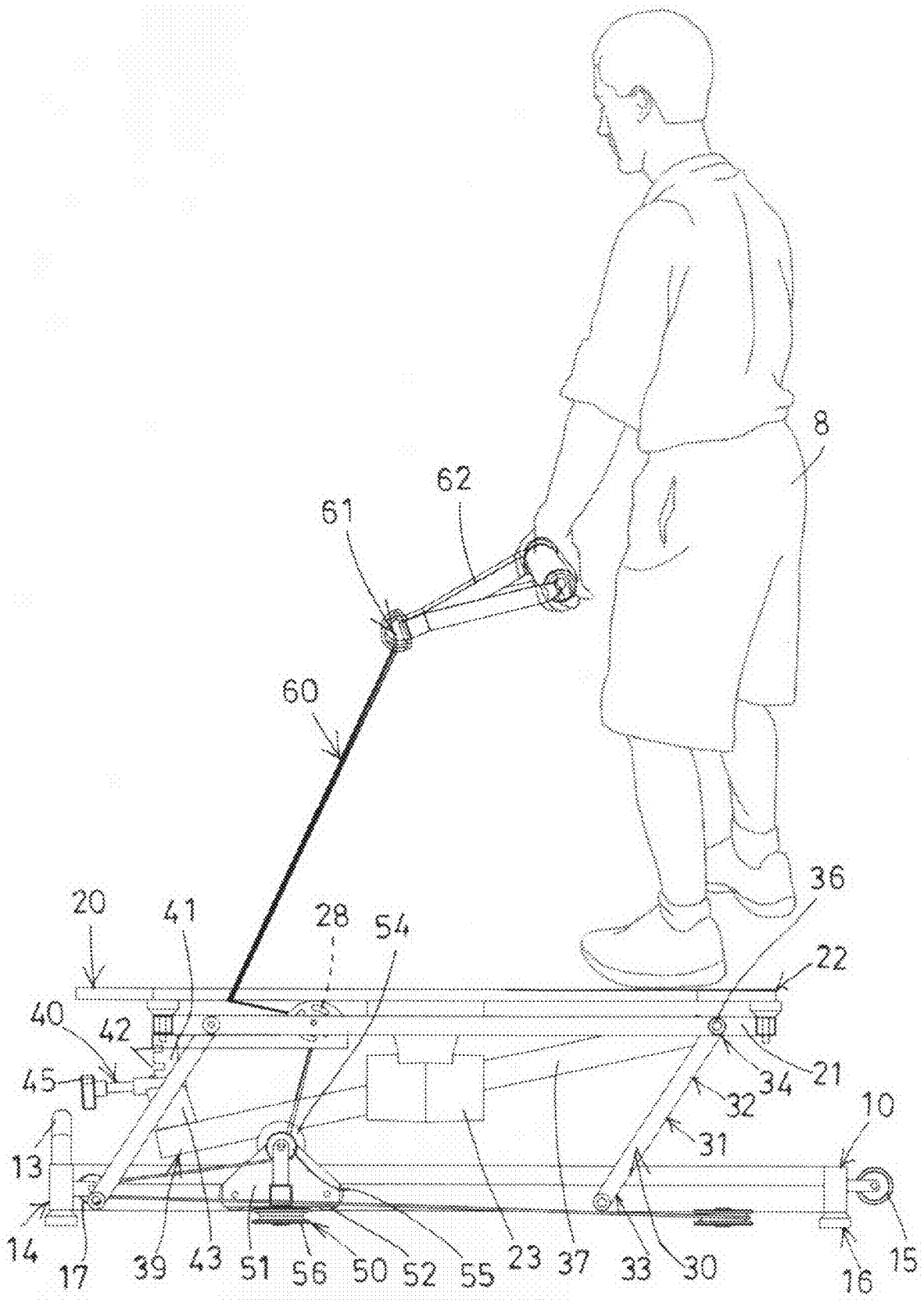
FIG. 6 is a side plan schematic view similar to FIG. 5, illustrating the operation of the physical exercising machine.

In operation, as shown in FIGS. 5 and 6, when the hand grips 62 or the end portions 61 of the cable 60 are pulled by the users, the pulleys 55 of the followers 51 may be pulled forwardly and the pulleys 55 of the followers 51 may be moved along the lever 37, in order to overcome the weight of the frame 21 and the platform 22 and the users 8, and so as to move the frame 21 or the platform 22 and the users 8 vertically up and down relative to the base 10, and then the frame 21 or the platform 22 and the users 8 may be moved downwardly relative to or toward the base 10 by the weight of the frame 21 and the platform 22 and the users 8 when the hand grips 61 of the cable 60 are released, such that the users may exercise or train their upper muscle groups.

Figure 7:
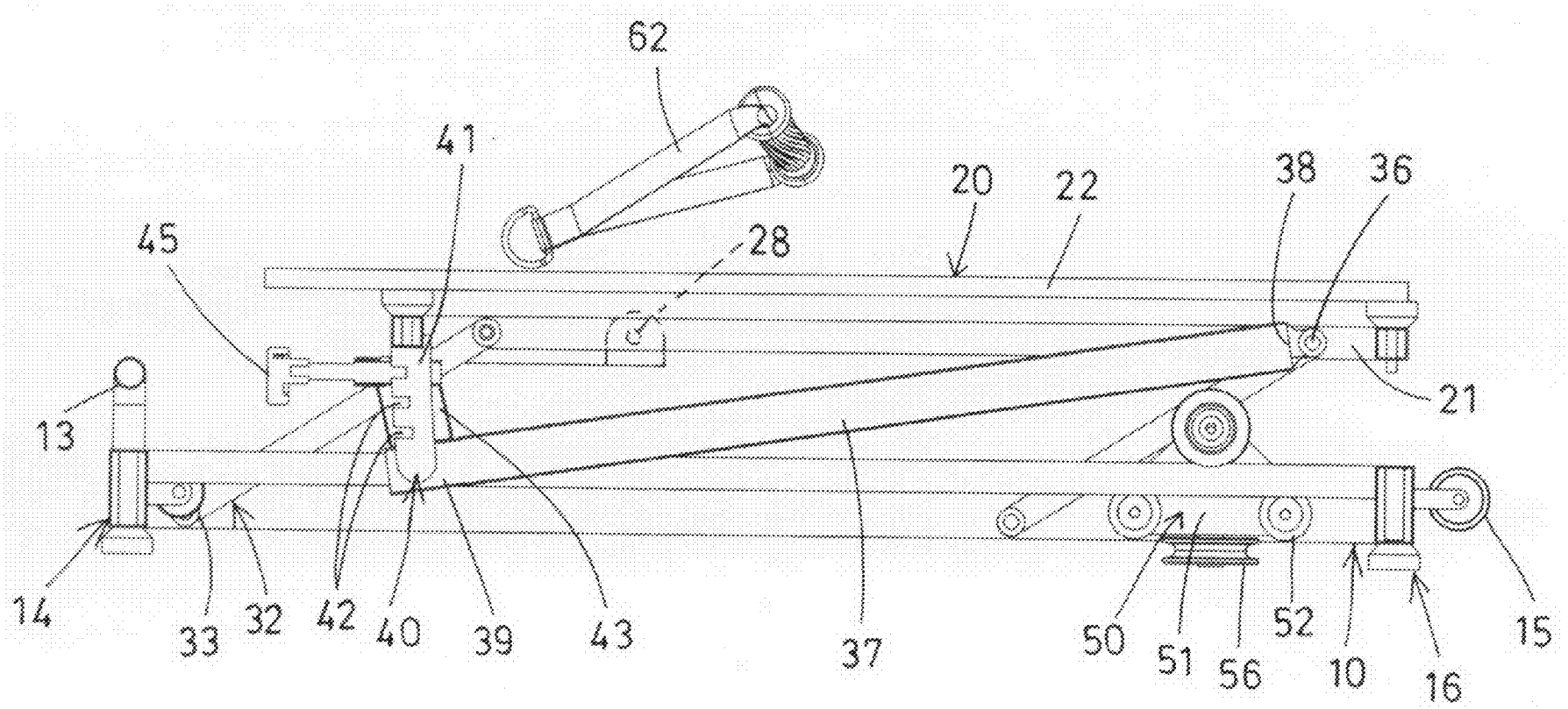
FIGS. 7, 8, 9 are side plan schematic views similar to FIG. 5, illustrating the adjusting operation of the physical exercising machine.
Figure 8:
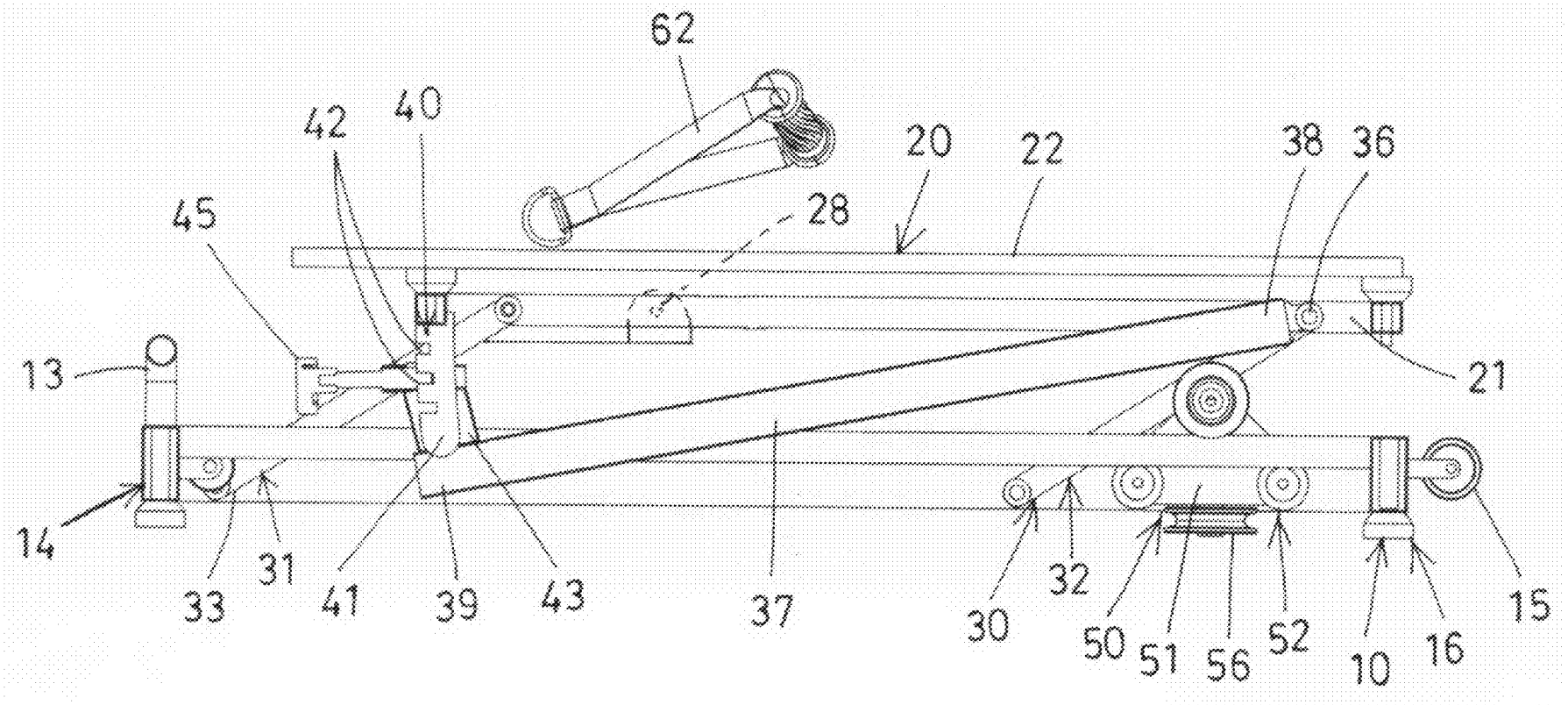
Figure 9:
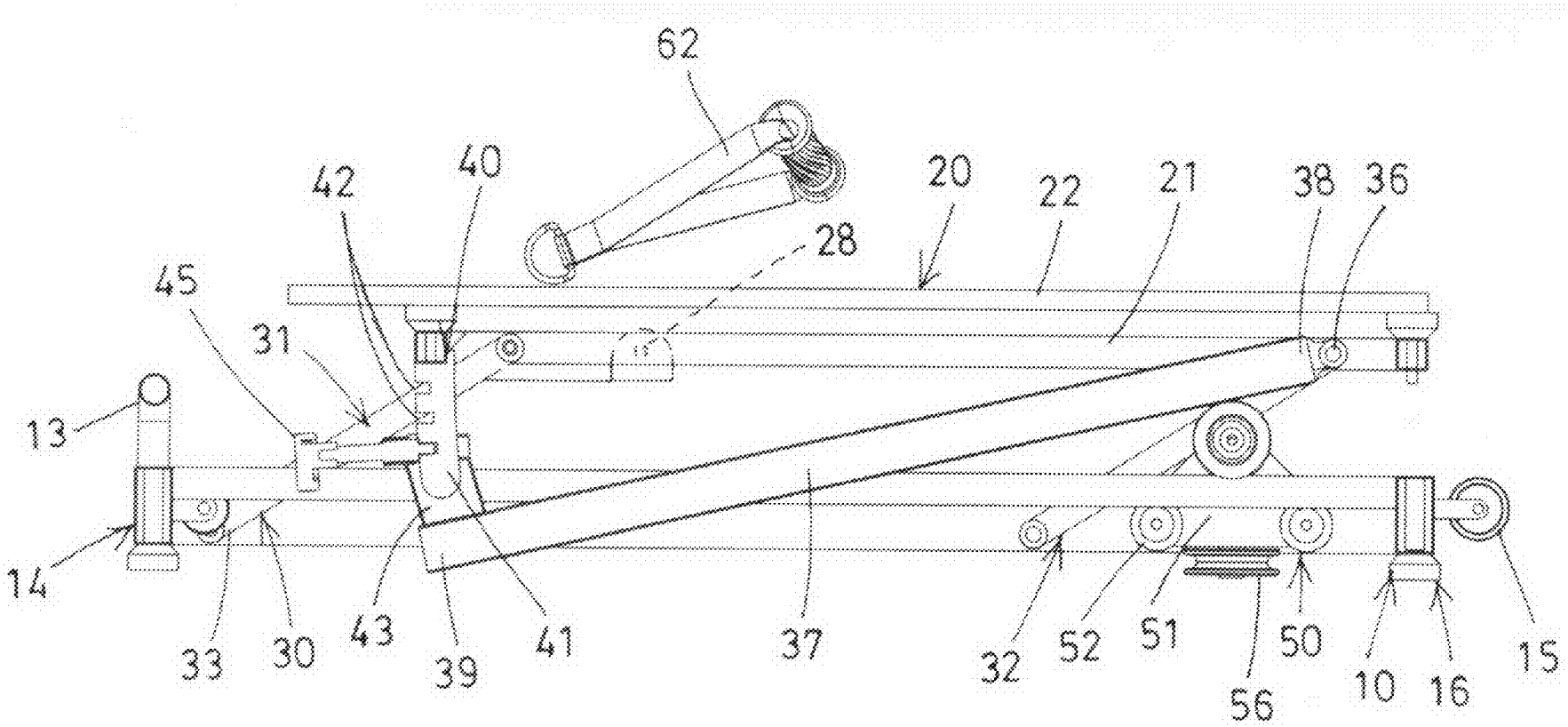

As shown in FIGS. 7-9, the latch 45 is slidably attached or mounted to the seat 43 for being biased to selectively engage with either of the notches 42 of the shank 41 and for adjustably attaching or coupling the other end portion 39 of the lever 37 to the frame 21 or the platform 22, and for adjusting the tilt or the inclination of the lever 37 relative to the frame 21 or the platform 22. When the inclination of the lever 37 relative to the frame 21 or the platform 22 is smaller (FIGS. 7, 8), the users may spend a relatively little or smaller energy to move the followers 51 along the lever 37 and to move the frame 21 or the platform 22 and the users 8 vertically up and down relative to the base 10. On the contrary, when the inclination of the lever 37 relative to the frame 21 or the platform 22 is greater (FIGS. 8, 9), the users may spend a relatively greater energy to move the followers 51 along the lever 37 and to move the frame 21 or the platform 22 and the users 8 vertically up and down relative to the base 10.

It is to be noted that the openings 24 are formed in the platform 22 and are each formed or defined by a smooth or curved or rounded inner peripheral surface 26 (FIGS. 1, 2) for smoothly engaging with the end portions 61 of the cable 60 and for preventing the cable 60 from being scraped and damaged by the platform 22, and arranged for allowing the end portions 61 of the cable 60 to be moved together with the platform 22 and to be located close to the users 8 for allowing the hand grips 61 of the end portions 61 of the cable 60 to be easily pulled or operated by the users, particularly when the users are standing on the platform 22. It is further to be noted that the base 10 and the frame 21 or the platform 22 of the carrier 20 may further include one or more still further pulleys 28, such as the further pulleys 28 that are attached to the frame 21 or the platform 22 of the carrier 20 for engaging with the end portions 61 of the cable 60 and for further suitably guiding the end portions 61 of the cable 60 to move through the openings 24 of the platform 22 without contacting or engaging with the inner peripheral surface 26 of the platform 22.

Accordingly, the physical exercising machine in accordance with the present invention includes an elevatable platform for stably supporting one or more users thereon and including a pulling cable coupled to the platform for pulling and elevating both the platform and the users and for exercising or training the upper muscle groups of the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A physical exercising machine comprising:

a base including at least one rail, a carrier including a platform for supporting a user thereon, a lever attached to said carrier and inclined relative to said carrier and said base, a pivotal coupling mechanism pivotally coupled between said base and said carrier for allowing said carrier and the user to be supported horizontally on said platform and to be moved vertically up and down relative to said base, an actuating mechanism including a follower slidably engaged with said at least one rail and to be moved along said at least one rail of said base, and slidably engaged with said lever for moving said platform and the user vertically up and down relative to said base when said follower is moved along said at least one rail of said base and when said follower is moved along said inclined lever, and a cable coupled to said follower and including two end portions for being pulled by the user and for moving said follower to engage with said lever and to move said platform and the user vertically up and down relative to said base.

2. The physical exercising machine as claimed in claim 1, wherein said follower includes a roller disposed thereon for engaging with said lever and for moving said platform and the user vertically up and down relative to said base.

3. The physical exercising machine as claimed in claim 1, wherein said follower includes at least one pulley disposed thereon for engaging with said cable.

4. The physical exercising machine as claimed in claim 3, wherein said follower includes at least one second pulley disposed thereon for engaging with said cable.

5. The physical exercising machine as claimed in claim 1, wherein said follower includes at least one roller engaged with said at least one rail and to be moved along said at least one rail of said base.

6. The physical exercising machine as claimed in claim 1, wherein said cable includes a hand grip attached to each of said end portions thereof for being pulled by the user.

7. The physical exercising machine as claimed in claim 1, wherein said carrier includes a vibrating device for vibrating said carrier and the user.

8. The physical exercising machine as claimed in claim 7, wherein said vibrating device is attached to said platform of said carrier.

9. The physical exercising machine as claimed in claim 1, wherein said platform includes two openings formed therein for engaging with said end portions of said cable.

10. The physical exercising machine as claimed in claim 1, wherein said lever includes a first end portion pivotally attached to said carrier and includes a second end portion, and said carrier includes a shank having at least two notches formed in said shank, and a latch attached to said second end portion of said lever for engaging with either of said at least two notches of said shank and for adjustably attaching said second end portion of said lever to said carrier, and for adjusting an inclination of said lever relative to said platform and said base.

11. The physical exercising machine as claimed in claim 1, wherein said actuating mechanism includes two rocker assemblies pivotally coupled between said base and said carrier.

12. The physical exercising machine as claimed in claim 11, wherein said rocker assemblies each include two rocker arms each having a lower portion pivotally coupled to said base, and each having an upper portion pivotally coupled to said carrier.

13. The physical exercising machine as claimed in claim 12, wherein said rocker arms each include a tube disposed on the upper portion thereof, and a shaft engaged with said tubes, and said lever includes a first end portion pivotally attached to said carrier with said shaft.

14. A physical exercising machine comprising:

a base including two rails, a carrier including a platform for supporting a user thereon, a lever attached to said carrier and inclined relative to said carrier and said base, a pivotal coupling mechanism pivotally coupled between said base and said carrier for allowing said carrier and the user to be supported horizontally on said platform and to be moved vertically up and down relative to said base, an actuating mechanism including two followers slidably engaged with said rails and to be moved along said rails, and including a roller slidably engaged with said lever for moving said platform and the user vertically up and down relative to said base when said followers are moved along said rails and when said followers are moved along said inclined lever, and a cable coupled to said followers and including two end portions for being pulled by the user and for moving said roller to engage with said lever and to move said platform and the user vertically up and down relative to said base.

15. The physical exercising machine as claimed in claim 14, wherein said actuating mechanism includes a rod coupled between said followers, and said roller is disposed on said rod for engaging with said lever.

16. The physical exercising machine as claimed in claim 14, wherein said followers each include a first pulley and at least one second pulley disposed thereon for engaging with said cable.

17. The physical exercising machine as claimed in claim 14, wherein said followers each include at least one roller engaged with said rails and to be moved along said rails of said base.

* * * * *